United States Patent [19]

Cousineau et al.

[11] Patent Number: 4,464,277

[45] Date of Patent: Aug. 7, 1984

[54] SYNTHETIC LUBRICANT COMPOSITION

[75] Inventors: Thomas J. Cousineau; John A. Cengel, both of Wheaton, Ill.

[73] Assignee: Standard Oil Company (Indiana), Chicago, Ill.

[21] Appl. No.: 436,443

[22] Filed: Oct. 25, 1982

[51] Int. Cl.[3] ..... C10M 1/26

[52] U.S. Cl. ..... 252/56 S; 252/56 R; 252/57; 560/127

[58] Field of Search ..... 252/56 S, 56 R, 57; 560/127, 193

[56] References Cited

U.S. PATENT DOCUMENTS 2,889,354 6/1959 Blake et al. ..... 252/57

3,409,553 11/1968 Scoggins et al. ..... 252/57

*Primary Examiner*—Jacqueline V. Howard

*Attorney, Agent, or Firm*—Richard A. Kretchmer; William T. McClain; William H. Magidson

[57] ABSTRACT

A lubricant and fuel composition comprising di-n-hexyl 1,3-cyclohexanedicarboxylate.

8 Claims, No Drawings

SYNTHETIC LUBRICANT COMPOSITION

BACKGROUND OF THE INVENTION

1. Field of the Invention

This invention relates to lubricant and fuel compositions. More particularly, it relates to di-n-hexyl 1,3-cyclohexanedicarboxylate and its use as a lubricant.

2. Description of the Prior Art

A wide variety of naturally occurring and synthetic oils have been used as lubricants to reduce friction between moving surfaces which are in contact with each other. Although mineral oils have most commonly been used for this purpose, synthetic materials such as olefin polymers, polyoxypropylene and certain carboxylic acid esters and naturally occurring oils such as cottonseed oil, corn oil, castor oil, lard oil and sperm oil have also been used. Typically, such lubricants are employed to lubricate internal combustion engines, gear trains, turbines, compressors and the like.

A satisfactory lubricating oil must possess a unique combination of properties. In particular, the oil must be noncorrosive and have good low temperature fluidity properties in combination with low volatility at elevated temperatures. In addition, good viscosity properties over a wide range of temperatures are highly desirable since proper lubrication in most applications requires that the lubricant be adaptable to changes in temperature without extreme variations in viscosity. Further, lubricants which are utilized at high temperatures, as in gas turbines and four-cycle internal combustion engines, must be resistant to oxidative and thermal degradation.

Two-cycle engines are lubricated by mixing the lubricant with the fuel for the engine. The mixture of fuel and lubricant passes through the crankcase of a two-cycle engine, where it lubricates the moving parts of the engine, and then flows through intake ports into the combustion chamber of the engine where the mixture of fuel and lubricant is burned. Finally, the combustion products are vented from the combustion chamber through exhaust ports. As a consequence, a satisfactory lubricant for two-cycle engines must not only provide adequate lubrication for moving engine parts but also must be able to pass into the combustion chamber without leaving objectionable deposits in the intake ports, must burn cleanly to avoid fouling the combustion chamber and spark plug with undesirable deposits, and must not result in fouling of the exhaust ports.

U.S. Pat. No. 3,701,730 to Daniels et al. discloses that esters of alcohols having 1 to 20 carbon atoms and aliphatic carboxylic acids having 3 to 20 carbon atoms can be used as lubricant base stocks. However, this patent contains no mention of di-n-hexyl 1,3-cyclohexanedicarboxylate and fails to suggest that such a material would be a particularly desirable lubricating oil.

U.S. Pat. No. 2,936,320 to Benoit discloses the use of dialkyl diesters of mixtures of isophthalic acid and terephthalic acid as synthetic lubricating oils. The esters of this patent are derived from alcohols of from 5 to 13 carbon atoms.

U.S. Pat. No. 3,409,553 to Scoggins et al. discloses a two-cycle engine lubricant which comprises a mixture of mineral oil with at least one ester selected from the group consisting of the bis(2-ethylhexyl) esters of 1,2- and 1,3-cyclohexanedicarboxylic acid. Similarly, U.S. Pat. No. 3,251,771 to Benoit discloses the use of dialkyl diesters of 1,4-cyclohexanedicarboxylic acid as a synthetic lubricant base oil. In addition, Matsuda et al. disclose the use of a hydrogenated 3:1 mixture of n-octyl and 2-ethylhexyl isophthalate as a component of a lubricating oil for jet engines at pages 2168–2171 of *Kogyo Kagaku Zasshi,* Vol. 64 (1961).

Although a plethora of lubricating oils are known to the art, there is no mention in the art of di-n-hexyl 1,3-cyclohexanedicarboxylate and no suggestion that this material would possess an unusually desirable combination of properties which serve to make it exceptionally satisfactory for use as a lubricant and for use as a blending component for lubricant formulations.

SUMMARY OF THE INVENTION

The present invention is directed to the discovery of di-n-hexyl 1,3-cyclohexanedicarboxylate and the use of this material as a lubricant.

One embodiment of the invention is a lubricant composition comprising di-n-hexyl 1,3-cyclohexanedicarboxylate.

Another embodiment of the invention is a lubricant composition comprising a mixture of di-n-hexyl 1,3-cyclohexanedicarboxylate and at least one oil of lubricating viscosity which is selected from the group consisting of mineral oils and olefin polymers, wherein the ratio by weight of said oil to di-n-hexyl 1,3-cyclohexanedicarboxylate is from about 95:5 to about 50:50.

Another embodiment of the invention is a two-cycle engine fuel composition comprising a liquid hydrocarbon of gasoline boiling range in admixture with a lubricant which comprises di-n-hexyl 1,3-cyclohexanedicarboxylate, wherein the ratio by weight of gasoline hydrocarbon to lubricant is from about 15:1 to about 100:1.

Another object of this invention is to provide an improved synthetic lubricant.

Another object of the invention is to provide a light blending agent which can be combined with mineral oil to improve the lubricant properties of said mineral oil.

Another object of this invention is to provide a light blending agent which can be combined with mineral oil to provide improved SAE 5W-30 lubricant formulations.

Another object of the invention is to provide an improved crankcase lubricant for automotive and light diesel use.

Another object of the invention is to provide a synthetic lubricant for internal combustion engines which will provide improved fuel efficiency.

A further object of the invention is to provide an improved lubricant for two-cycle internal combustion engines.

A still further object of the invention is to provide an improved two-cycle engine fuel composition.

DETAILED DESCRIPTION OF THE INVENTION

We have discovered that di-n-hexyl 1,3-cyclohexanedicarboxylate possesses a combination of properties which serve to make this material unusually desirable as a lubricant and lubricant component. This material is particularly well adapted for use as a blending agent in the formulation of crankcase lubricants for internal combustion engines, and is characterized by a slate of properties which include excellent low temperature viscosity, low volatility at elevated temperatures, resistance to oxidation, and a high viscosity index which is indicative of a relatively small variation of viscosity with change in temperature. In addition, this material also provides improved fuel efficiency, in comparison with mineral oils, when used as a lubricant in internal combustion engines.

Di-n-hexyl 1,3-cyclohexanedicarboxylate is a highly satisfactory base oil for use in the formulation of lubricants and can be used either neat or as a blending component in combination with any of the conventional base oils which are utilized in the formulation of lubricants. Such conventional base oils include, but are not limited to, mineral oils, olefin polymers, polyoxypropylene, cottonseed oil, corn oil, castor oil, lard oil, sperm oil and certain synthetic esters such as ethyl palmitate, ethyl laurate, butyl stearate, dioctyl azelate, bis(2-ethylhexyl) azelate and bis(2-ethylhexyl) phthalate.

Di-n-hexyl 1,3-cyclohexanedicarboxylate is a particularly desirable blending agent for combination with conventional mineral oil base stocks to improve the viscosity properties of these conventional base stocks. The subject diester is highly effective as a light blending stock for use with heavy mineral oils to produce, for example, SAE 5W-20 and SAE 5W-30 crankcase formulations for automotive or light diesel applications. The diester has a sufficiently low volatility so that it is not lost from these blends under conventional conditions of high temperature service.

Di-n-hexyl 1,3-cyclohexanedicarboxylate is also a highly desirable blending agent for combination with olefin polymer base stocks to improve the viscosity properties of these materials. Suitable olefin polymers include those polymers of lubricating viscosity. Desirably, such polymers have a molecular weight in the range from about 350 to about 1000, and preferred olefin polymers are derived from alpha-olefins. For example, olefin polymers derived from 1-decene and containing from 30 to 50 carbon atoms are highly suitable for use as a base stock.

Although di-n-hexyl 1,3-cyclohexanedicarboxylate can be blended in any proportions with mineral oil and olefin polymer base stocks, the ratio of mineral oil or olefin polymer to diester is desirably from about 95:5 to about 50:50 and preferably from about 90:10 to about 60:40. At these ratios, the amount of diester is generally sufficient to impart satisfactory viscosity properties to the blend. Since the diester is typically somewhat more expensive than mineral oil, excessive use of the diester in such a blend is frequently undesirable on the basis of cost considerations.

The mineral oils which can be blended with the di-n-hexyl 1,3-cyclohexanedicarboxylate of this invention include any hydrocarbon oil of lubricating viscosity. However, preferred mineral oils have a Saybolt Universal viscosity of 100° F. (37.8° C.) of from about 50 to about 1000 seconds, and more preferably this viscosity is from about 70 to about 300 seconds.

Although they are not ideal, conventional mineral oils have been widely used as lubricants for two-cycle engines. We have now found that di-n-hexyl 1,3-cyclohexanedicarboxylate is a satisfactory alternative to mineral oil for this application. In particular, a blend of this diester with mineral oil is highly satisfactory for use as a two-cycle engine lubricant. In such an application, the ratio of mineral oil to diester is desirably from about 95:5 to about 50:50 and preferably from about 90:10 to about 60:40. The lubricant employed in a two-cycle engine is, of course, incorporated into the fuel for the engine. Such a fuel composition generally comprises a mixture of gasoline and lubricant wherein the ratio by weight of gasoline to lubricant is from about 15:1 to about 100:1. A suitable gasoline includes any liquid hydrocarbon fuel in the gasoline boiling range which is typically from about 20° to about 225° C.

Di-n-hexyl 1,3-cyclohexanedicarboxylate exists in two isomeric forms. In the cis isomer, both of the carboalkoxy groups are oriented on the same side of the cyclohexane ring, whereas in the trans isomer the carboalkoxy groups are oriented on opposite sides of the cyclohexane ring. Although both cis and trans isomers are suitable for use in accordance with this invention, it is generally preferred to use a mixture of these isomers since such a mixture is more easily prepared than either the pure cis or pure trans isomer. In addition, it is believed that a mixture of the isomers may possess improved viscosity properties in comparison with either of the pure isomers. A preferred mixture contains a weight ratio of cis to trans isomers of from about 50:50 to about 90:10.

Di-n-hexyl 1,3-cyclohexanedicarboxylate can be prepared by hydrogenation of isophthalic acid followed by esterification of the resulting 1,3-cyclohexanedicarboxylic acid with n-hexanol. The isophthalic acid can be hydrogenated under conventional conditions. For example, the hydrogenation can be carried out at a hydrogen pressure of 600-1500 psi (42–105 kg/cm$^2$) using 5% rhodium on carbon as the catalyst either in ethyl acetate solution at 105°–120° C. or as an aqueous slurry at 100°–110° C.

Alternatively, di-n-hexyl 1,3-cyclohexanedicarboxylate can also be prepared by esterification of isophthalic acid with n-hexanol followed by hydrogenation of the resulting di-n-hexyl isophthalate under conventional conditions. For example, hydrogenation catalysts such as palladium, platinum, rhodium and/or ruthenium on alumina can be used at a temperature of about 165° C. with a hydrogen pressure of about 1200–1700 psi (84–120 kg/cm$^2$).

The di-n-hexyl 1,3-cyclohexanedicarboxylate of this invention can be used in combination with any of the conventional lubricating oil additives known to the art which include, but are not limited to, extreme pressure agents, friction modifiers, viscosity index improvers, antioxidants, corrosion inhibitors, wear inhibitors, dispersants, detergents, pour point depressants and antifoam agents.

In Tables I and II, di-n-hexyl 1,3-cyclohexanedicarboxylate is compared with a variety of other oils in terms of viscosity properties and viscosity index, pour point and boiling range characteristics. On the basis of the data in these tabulations, it is observed that all but one of the aromatic diesters has a poor viscosity index relative to mineral oil. In contrast, the hydrogenated derivatives of these aromatic diesters generally have a comparable or better balance of low temperature viscosity and viscosity index than mineral oil. Further, di-n-hexyl 1,3-cyclohexanedicarboxylate is unexpectedly superior to di-n-hexyl 1,2-cyclohexanedicarboxylate in terms of viscosity index, and is also unexpectedly superior to di-n-hexyl 1,4-cyclohexanedicarboxylate in terms of low temperature viscosity properties. Tables I and II also demonstrate that di-n-hexyl 1,3-cyclohexanedicarboxylate possesses a unique blend of physical properties which is characteristic of a highly desirable lubricating oil.

Table III illustrates the unusually desirable properties of di-n-hexyl 1,3-cyclohexanedicarboxylate as a light blending agent, in combination with 170 neutral mineral oil, to achieve conventional target viscosities. The data which are set forth in Table III illustrate that less di-n-hexyl 1,3-cyclohexanedicarboxylate was required than any of the other materials tested to achieve the target viscosities. Since mineral oil is relatively inexpensive in comparison with a synthetic diester lubricating oil, this is a distinct advantage of di-n-hexyl 1,3-cyclohexanedicarboxylate. In addition, the di-n-hexyl 1,3-cyclohexanedicarboxylate blend required the use of a relatively small amount of viscosity index improver in comparison with the amounts required in most of the other blends examined.

Table III also sets forth the results of a series of hot tube-$NO_2$ tests for the various tabulated blends. This test is a measure of the ability of a lubricant formulation to resist oxidation and varnish formation. More specifically, a measured quantity of the lubricant formulation is metered into a 2 mm diameter heated glass tube through which heated nitrogen dioxide is passed. At the conclusion of the test, the extent of deposit formation on the interior walls of the tube is evaluated. The tubes are rated on a scale from zero to ten, with zero representing a heavy black opaque deposit and ten representing a perfectly clean tube. The hot tube tests which are set forth in Table III demonstrate that all of the synthetic diesters, including di-n-hexyl 1,3-cyclohexanedicarboxylate, are far more resistant to oxidation than the 110 neutral mineral oil which was used as a reference.

TABLE I

Comparison of Viscosity Properties of Di-n-hexyl 1,3-Cyclohexanedicarboxylate with Other Oils

| Oil[a] | Viscosity[b] −25° C. P | −18° C. P | 40° C. CST | 100° C. CST |
|---|---|---|---|---|
| Di-n-hexyl 1,3-CD | <5.0 | <5.0 | 8.85 | 2.59 |
| 110 Neutral Mineral Oil | 15.0 | 8.6 | 21.91 | 4.23 |
| Di-n-hexyl Phthalate | — | <5.0 | 12.08 | 2.79 |
| Di-n-octyl Phthalate | — | 5.1 | 15.97 | 3.39 |
| Bis(2-ethylhexyl) Phthalate | — | 22.0 | 26.67 | 4.20 |
| Di-n-hexyl Isophthalate | — | 5.3 | 14.70 | 3.22 |
| Di-n-octyl Isophthalate | — | 8.5 | 21.26 | 4.22 |
| Bis(2-ethylhexyl) Isophthalate | — | 23.7 | 28.30 | 4.41 |
| Bis(2-ethylhexyl) Terephthalate | — | 22.5 | 29.95 | 4.81 |
| Di-n-hexyl 1,2-CD | — | <5.0 | 9.18 | 2.42 |
| Di-n-octyl 1,2-CD | 6.3 | <5.0 | 12.55 | 2.99 |
| Bis(2-ethylhexyl) 1,2-CD | — | 9.4 | 18.14 | 3.45 |
| Di-n-octyl 1,3-CD | <5.0 | <5.0 | 12.60 | 3.33 |
| Bis(2-ethylhexyl) 1,3-CD | 11.4 | 5.0 | 15.36 | 3.42 |
| Di-n-decyl 1,3-CD | <5.0 | <5.0 | 18.19 | 4.40 |
| Di-n-hexyl 1,4-CD | — | Solid | 9.16 | 2.67 |
| Di-n-octyl 1,4-CD | — | Solid | 15.01 | 3.76 |
| Bis(2-ethylhexyl) 1,4-CD | 12.5 | 5.6 | 17.15 | 3.91 |

[a]Where used, CD represents Cyclohexanedicarboxylate.
[b]Where used, P represents poise and CST represents centistokes.

TABLE II

Comparison of Viscosity Index, Pour Point and Boiling Range Characteristics of Di-n-hexyl 1,3-Cyclohexanedicarboxylate with Other Oils

| Oil[a] | Viscosity Index | Pour Point, °C. | Boiling Range, °C. |
|---|---|---|---|
| Di-n-hexyl 1,3-CD | 130 | <−60 | 377–386 |
| 110 Neutral Mineral Oil | 93 | −15 | 355–419 |
| Di-n-hexyl Phthalate | 56 | <−60 | |
| Di-n-octyl Phthalate | 73 | −40 | |
| Bis(2-ethylhexyl) Phthalate | 17 | −48 | |
| Di-n-hexyl Isophthalate | 72 | −60 | |
| Di-n-octyl Isophthalate | 101 | −33 | |

TABLE II-continued

Comparison of Viscosity Index, Pour Point and Boiling Range Characteristics of Di-n-hexyl 1,3-Cyclohexanedicarboxylate with Other Oils

| Oil[a] | Viscosity Index | Pour Point, °C. | Boiling Range, °C. |
|---|---|---|---|
| Bis(2-ethylhexyl) Isophthalate | 31 | −45 | |
| Bis(2-ethylhexyl) Terephthalate | 68 | −45 | |
| Di-n-hexyl 1,2-CD | 75 | −60 | |
| Di-n-octyl 1,2-CD | 115 | −51 | 412–414 |
| Bis(2-ethylhexyl) 1,2-CD | 34 | −48 | |
| Di-n-octyl 1,3-CD | 141 | −54 | 430–433 |
| Bis(2-ethylhexyl) 1,3-CD | 93 | −54 | |
| Di-n-decyl 1,3-CD | 161 | −33 | 445–454 |
| Di-n-hexyl 1,4-CD | 135 | −18 | |
| Di-n-octyl 1,4-CD | 146 | −6 | |
| Bis(2-ethylhexyl) 1,4-CD | 124 | −60 | |

[a]Where used, CD represents Cyclohexanedicarboxylate.

TABLE III

Amount of Various Synthetic Diesters Required for Blending With 170 Neutral Mineral Oil to Achieve a Mixture Having a Viscosity of 10.0 Centistokes at 100° C. and 12.0 Poise at −18° C.

| Diester[a,b] | Hot Tube Test | Dispersant-Viscosity Index Improver,[d] Wt. % | 170 Neutral Mineral Oil, Wt. % | Diester, Wt. % |
|---|---|---|---|---|
| 110 Neutral Mineral Oil[c] | 1.5 | 11.8 | 0 | 0 |
| Di-n-hexyl Phthalate | 8 | 13.8 | 47.0 | 32.6 |
| Di-n-octyl Phthalate | 8 | 13.0 | 41.0 | 39.4 |
| Di-n-hexyl Isophthalate | 4 | 13.5 | 34.4 | 45.5 |
| Di-n-hexyl 1,2-CD | 8 | 12.4 | 55.1 | 25.9 |
| Di-n-octyl 1,2-CD | 8 | 12.1 | 48.0 | 33.3 |
| Bis(2-ethylhexyl) 1,2-CD[e] | — | — | — | — |
| Di-n-hexyl 1,3-CD | 7 | 11.5 | 61.4 | 20.5 |
| Di-n-octyl 1,3-CD | 7 | 11.4 | 54.9 | 27.1 |
| Bis(2-ethylhexyl) 1,3-CD | 8 | 13.1 | 29.7 | 50.6 |
| Di-n-decyl 1,3-CD | — | 10.0 | 49.2 | 34.2 |

[a]Where used, CD represents Cyclohexanedicarboxylate.
[b]Each blend contained 6.6 wt. % of a conventional dispersant inhibitor package consisting of a mixture of Mannich dispersant, zinc dialkyldithiophosphate, overbased calcium phenate, and magnesium sulfonate.
[c]Does not meet −18° C. target viscosity.
[d]A Mannich-type dispersant-viscosity index improver was used.
[e]Too viscous to meet target viscosities.

EXAMPLE I

Five hundred grams of di-n-hexyl isophthalate and 10 grams of 0.5% ruthenium on alumina catalyst (in the form of ⅛" pellets) were sealed in a 1-liter stainless steel autoclave which was equipped with a heater and stirrer. The autoclave was purged three times with nitrogen and, subsequently, three times with hydrogen by introducing the gases to a pressure of 300 psi (21 kg/cm$^2$) followed by venting the autoclave to the atmosphere. The vessel was then pressurized to 1300 psi (91 kg/cm$^2$) with hydrogen, and agitation and heating of the reaction mixture were initiated. The reaction was carried out at 330° F. (166° C.) and the autoclave was repressurized to 1700 psi (120 kg/cm$^2$) with hydrogen whenever the pressure dropped to the 1200–1300 psi (84–91 kg/cm$^2$) range. After 12 hours, an additional 10 grams of catalyst were added, and hydrogenation was continued under the above-described conditions for an additional 2 hours. Analysis of the resulting hydrogenation product by gas chromatography indicated a quantitative conversion of starting material to di-n-hexyl 1,3-cyclohexanedicarboxylate. The product contained 67.3% of the cis isomer, and the ratio of cis to trans isomers was 67.3:32.7.

We claim:

1. Di-n-hexyl 1,3-cyclohexanedicarboxylate.

2. The composition of claim 1 which consists of a mixture of cis and trans isomers.

3. The composition as set forth in claim 2 wherein the ratio by weight of cis to trans isomers is from about 50:50 to about 90:10.

4. A lubricant composition comprising a mixture of di-n-hexyl 1,3-cyclohexanedicarboxylate and at least one oil of lubricating viscosity which is selected from the group consisting of mineral oils and olefin polymers, wherein the ratio by weight of said oil to di-n-hexyl 1,3-cyclohexanedicarboxylate is from about 95:5 to about 50:50.

5. The composition as set forth in claim 4 wherein said oil of lubricating viscosity is a mineral oil.

6. The composition as set forth in claim 5 wherein the ratio by weight of mineral oil to di-n-hexyl 1,3-cyclohexanedicarboxylate is from about 90:10 to about 60:40.

7. The composition as set forth in claim 5 wherein said di-n-hexyl 1,3-cyclohexanedicarboxylate comprises a mixture of cis and trans isomers.

8. The composition as set forth in claim 7 wherein the ratio by weight of cis to trans isomers is from about 50:50 to about 90:10.

* * * * *